US008813262B2

(12) United States Patent
Pechtold

(10) Patent No.: US 8,813,262 B2
(45) Date of Patent: Aug. 26, 2014

(54) WRIST PROTECTOR FOR A SPORT GLOVE

(75) Inventor: André Pechtold, Oberscheinfeld (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 13/396,021

(22) Filed: Feb. 14, 2012

(65) Prior Publication Data

US 2012/0204304 A1 Aug. 16, 2012

(30) Foreign Application Priority Data

Feb. 14, 2011 (DE) ..... 10 2011 004 039

(51) Int. Cl.
*A41D 13/08* (2006.01)
*A41D 19/00* (2006.01)

(52) U.S. Cl.
USPC ..... 2/17; 2/16; 2/162; 2/167

(58) Field of Classification Search
None
See application file for complete search history.

(56) References Cited

U.S. PATENT DOCUMENTS

| | | | | |
|---|---|---|---|---|
| 991,036 | A | 5/1911 | Spiegelman | |
| 1,377,103 | A * | 5/1921 | Suhr | 2/16 |
| 1,586,698 | A | 6/1926 | Posner | |
| 1,951,190 | A | 3/1934 | Gambee | |
| 2,251,551 | A | 8/1941 | O'Reilly | |
| 2,302,694 | A | 11/1942 | Jennings | |
| 3,707,730 | A | 1/1973 | Slider | |
| 3,714,940 | A * | 2/1973 | Palmer | 602/21 |
| 3,732,575 | A | 5/1973 | Pakulak | |
| 3,815,587 | A * | 6/1974 | Guerrant | 602/21 |
| 3,838,853 | A | 10/1974 | Fredenhagen | |
| 3,855,633 | A * | 12/1974 | Rhee | 2/18 |
| 4,051,553 | A | 10/1977 | Howard | |
| 4,183,098 | A | 1/1980 | Knowles | |
| 4,187,620 | A | 2/1980 | Selner | |
| 4,214,579 | A * | 7/1980 | Ford | 602/4 |
| 4,253,660 | A | 3/1981 | Tiktin | |
| 4,272,849 | A | 6/1981 | Thurston et al. | |
| 4,292,963 | A * | 10/1981 | Ford | 602/21 |
| 4,354,280 | A | 10/1982 | Hayes | |
| 4,366,634 | A | 1/1983 | Giese et al. | |
| 4,368,883 | A | 1/1983 | Tiktin | |
| RE31,538 | E | 3/1984 | Antonious | |
| 4,441,213 | A | 4/1984 | Trumble et al. | |

(Continued)

FOREIGN PATENT DOCUMENTS

| | | |
|---|---|---|
| CH | 577328 | 7/1976 |
| DE | 2732463 | 2/1979 |

(Continued)

OTHER PUBLICATIONS

Three photos of adidas, "Fingersave Glove", on sale at least as early as Feb. 12, 2002, 3 pages.

(Continued)

*Primary Examiner* — Bobby Muromoto, Jr.
(74) *Attorney, Agent, or Firm* — Kilpatrick Townsend & Stockton LLP

(57) ABSTRACT

Wrist protectors for a sport glove include a bending element configured to bend during bending of the wrist. The bending element may be further configured so that the length of the bending element changes during bending of the wrist, wherein a change of the length of the bending element leads to an elastic restoring force.

14 Claims, 10 Drawing Sheets

(56) References Cited

U.S. PATENT DOCUMENTS 4,441,490 A * 4/1984 Nirschl ..... 602/21
4,476,857 A * 10/1984 Levine ..... 602/20
4,489,716 A 12/1984 Blackwood et al.
4,507,804 A 4/1985 Consigny
4,524,464 A 6/1985 Primiano et al.
4,561,122 A 12/1985 Stanley et al.
4,565,195 A 1/1986 Eisenberg
4,570,269 A 2/1986 Berlese
4,584,993 A * 4/1986 Nelson ..... 602/21
4,663,783 A 5/1987 Obayashi
4,680,812 A 7/1987 Weigl
4,691,387 A 9/1987 Lopez
4,698,851 A 10/1987 Dunford et al.
4,706,658 A * 11/1987 Cronin ..... 602/13
4,738,447 A 4/1988 Brown
4,742,579 A 5/1988 Dunford
4,756,026 A * 7/1988 Pierce, Jr. ..... 2/16
4,765,320 A * 8/1988 Lindemann et al. ..... 602/22
4,766,612 A 8/1988 Patton
4,776,111 A 10/1988 Crowley
4,779,289 A 10/1988 Prouty
4,787,376 A 11/1988 Eisenberg
4,790,300 A * 12/1988 Marx ..... 602/21
4,815,147 A 3/1989 Gazzano et al.
4,862,877 A * 9/1989 Barber ..... 602/22
4,864,659 A 9/1989 Morris
4,865,023 A 9/1989 Craythorne et al.
4,884,561 A 12/1989 Letson, Sr.
4,911,433 A 3/1990 Walker et al.
4,922,630 A 5/1990 Robinson
4,930,162 A 6/1990 Cote
4,949,711 A * 8/1990 Gyovai et al. ..... 602/21
4,958,384 A 9/1990 McCrane
4,995,119 A 2/1991 Codkind
4,999,847 A 3/1991 Barcelo
5,018,221 A 5/1991 Romandetto
5,033,119 A 7/1991 Wiggins
5,050,319 A 9/1991 Perotto et al.
5,056,509 A 10/1991 Swearington
5,067,175 A 11/1991 Gold
5,078,128 A 1/1992 Grim et al.
5,083,314 A 1/1992 Andujar
D323,910 S 2/1992 Pierce
5,107,544 A 4/1992 Capatosto
5,125,171 A 6/1992 Stewart
5,133,775 A 7/1992 Chen
5,136,725 A 8/1992 Montero
5,140,995 A 8/1992 Uhl
5,152,082 A 10/1992 Culpepper
5,160,314 A * 11/1992 Peters ..... 602/21
5,175,947 A 1/1993 Parracho
5,222,256 A 6/1993 Wang
5,257,418 A 11/1993 Jaskiewicz
5,261,393 A * 11/1993 Weinzweig ..... 601/40
5,267,677 A 12/1993 Nash
5,295,269 A 3/1994 Ballard
5,307,521 A 5/1994 Davis
5,309,573 A * 5/1994 Solar et al. ..... 2/160
5,330,391 A 7/1994 Mitchell
5,358,469 A 10/1994 Patchel et al.
5,417,645 A * 5/1995 Lemmen ..... 602/21
5,456,650 A 10/1995 Williams, Jr. et al.
5,458,564 A * 10/1995 Franzen ..... 602/21
5,486,157 A 1/1996 DiBenedetto
5,511,242 A 4/1996 Bianchi
5,511,243 A 4/1996 Hall et al.
5,513,657 A * 5/1996 Nelson ..... 128/879
5,551,083 A 9/1996 Goldsmith
5,557,803 A 9/1996 Granich et al.
5,594,954 A 1/1997 Huang
5,604,931 A * 2/1997 Rhoades ..... 2/16
5,628,069 A 5/1997 Ebert
5,640,712 A 6/1997 Hansen et al.
5,706,521 A * 1/1998 Haney ..... 2/160
5,708,981 A * 1/1998 Tilton ..... 2/170
5,741,222 A 4/1998 Fiore
5,758,365 A 6/1998 Steeley
5,768,117 A 6/1998 Takahashi et al.
5,768,710 A 6/1998 Williams
5,768,717 A 6/1998 Le Sueur
5,769,804 A * 6/1998 Harris et al. ..... 602/21
5,774,896 A 7/1998 Hochmuth
5,774,897 A 7/1998 Hochmuth
5,778,449 A * 7/1998 Oetting et al. ..... 2/16
5,792,087 A 8/1998 Pringle
5,799,659 A 9/1998 Stano
5,802,614 A 9/1998 Melone, Jr.
5,807,293 A * 9/1998 Wedge, Jr. ..... 602/21
5,809,571 A 9/1998 Spitzer
5,810,754 A 9/1998 Kenosh
5,815,838 A 10/1998 Lord et al.
5,848,440 A 12/1998 Pajarola
5,876,363 A * 3/1999 Marx ..... 602/21
5,881,385 A 3/1999 Hochmuth
5,884,329 A 3/1999 Goldsmith et al.
5,891,079 A * 4/1999 Barnes ..... 602/61
5,894,684 A 4/1999 Sand et al.
5,896,683 A 4/1999 Foxen et al.
5,898,943 A 5/1999 Kim
5,921,945 A * 7/1999 Gray ..... 602/5
5,928,172 A * 7/1999 Gaylord ..... 602/21
5,933,868 A 8/1999 Bender
5,937,444 A 8/1999 Hochmuth
5,946,720 A 9/1999 Sauriol
5,963,985 A 10/1999 Behr et al.
5,974,588 A 11/1999 Furman
5,983,396 A 11/1999 Morrow et al.
6,012,170 A 1/2000 Kim
6,024,712 A 2/2000 Iglesias et al.
6,029,376 A 2/2000 Cass
6,083,184 A 7/2000 Kenosh
6,088,835 A 7/2000 Perkins et al.
6,095,994 A * 8/2000 Spits ..... 602/22
6,099,446 A * 8/2000 Johnson et al. ..... 482/124
6,112,434 A 9/2000 Seltzer et al.
6,119,271 A 9/2000 Byon
6,122,434 A 9/2000 Sawabe et al.
D436,148 S 1/2001 Villepigue
6,223,350 B1 5/2001 McFarlane
6,261,253 B1 * 7/2001 Katzin ..... 602/21
6,279,163 B1 8/2001 Hale et al.
6,293,919 B1 * 9/2001 Manente ..... 602/21
6,342,043 B1 1/2002 Gottsmann et al.
D454,231 S 3/2002 McFarlane
6,415,443 B1 7/2002 Schierenbeck et al.
6,427,695 B1 8/2002 Zanetti et al.
6,438,759 B1 * 8/2002 Jaunault et al. ..... 2/167
6,458,091 B1 * 10/2002 Parker et al. ..... 602/21
6,526,592 B1 3/2003 Best
6,540,710 B1 * 4/2003 Cruz ..... 602/21
6,543,057 B2 * 4/2003 Beland et al. ..... 2/161.1
6,557,177 B2 5/2003 Hochmuth
6,687,920 B2 2/2004 Berns
6,715,218 B2 4/2004 Johnson
6,725,466 B2 4/2004 Hochmuth
6,880,172 B2 * 4/2005 Quintero ..... 2/16
D504,981 S 5/2005 Vanderhoef
6,918,137 B2 7/2005 Fowler
6,944,884 B1 * 9/2005 Sokolowski ..... 2/161.1
D521,644 S 5/2006 Nordt et al.
7,043,762 B2 * 5/2006 Greenhalgh ..... 2/16
7,143,447 B2 12/2006 Fleischmann
7,156,819 B2 * 1/2007 Sieller et al. ..... 602/21
7,175,603 B2 * 2/2007 Fritsch et al. ..... 602/20
7,293,296 B1 11/2007 Beraznik et al.
7,313,831 B2 1/2008 Wilder et al.
7,318,812 B2 * 1/2008 Taylor et al. ..... 602/21
7,320,145 B2 1/2008 Hochmuth
7,329,229 B2 * 2/2008 Scheinberg et al. ..... 602/5
7,329,230 B2 2/2008 Mazzarolo
7,451,493 B2 11/2008 Godshaw
7,677,939 B2 * 3/2010 Dahl ..... 441/58
7,892,194 B2 * 2/2011 Farrell et al. ..... 602/21
8,037,549 B2 * 10/2011 Saur et al. ..... 2/455

(56) References Cited

U.S. PATENT DOCUMENTS

| | | | | |
|---|---|---|---|---|
| 8,201,272 | B2 * | 6/2012 | Winningham | 2/161.1 |
| 8,328,744 | B2 * | 12/2012 | Farrell et al. | 602/21 |
| 8,341,763 | B2 * | 1/2013 | Geyer et al. | 2/21 |
| 8,341,767 | B2 * | 1/2013 | Winningham | 2/161.1 |
| 8,348,810 | B2 * | 1/2013 | Land et al. | 482/47 |
| 2002/0072696 | A1 * | 6/2002 | Varn | 602/13 |
| 2002/0073477 | A1 | 6/2002 | Hochmuth | |
| 2002/0184695 | A1 * | 12/2002 | Fowler | 2/159 |
| 2002/0184696 | A1 | 12/2002 | Hochmuth | |
| 2004/0148675 | A1 | 8/2004 | Powell | |
| 2005/0101897 | A1 * | 5/2005 | Froom | 602/21 |
| 2005/0114982 | A1 | 6/2005 | Gremmert | |
| 2005/0153153 | A1 * | 7/2005 | Saur et al. | 428/542.8 |
| 2005/0197608 | A1 * | 9/2005 | Taylor et al. | 602/21 |
| 2005/0197611 | A1 * | 9/2005 | Taranow | 602/62 |
| 2005/0234375 | A1 * | 10/2005 | Grim et al. | 602/8 |
| 2005/0240140 | A1 * | 10/2005 | Nelson et al. | 602/64 |
| 2006/0026738 | A1 | 2/2006 | Kleinert | |
| 2006/0048259 | A1 | 3/2006 | Keppler et al. | |
| 2006/0211964 | A1 * | 9/2006 | Farrell et al. | 602/5 |
| 2006/0253951 | A1 * | 11/2006 | Mueller et al. | 2/16 |
| 2006/0281573 | A1 | 12/2006 | Lee | |
| 2007/0022512 | A1 * | 2/2007 | Coulter et al. | 2/161.1 |
| 2007/0028354 | A1 | 2/2007 | Hochmuth | |
| 2007/0074332 | A1 | 4/2007 | Wilder et al. | |
| 2007/0226866 | A1 * | 10/2007 | Geyer et al. | 2/16 |
| 2007/0261149 | A1 | 11/2007 | Gait | |
| 2008/0081525 | A1 * | 4/2008 | Dahl | 441/56 |
| 2008/0082032 | A1 * | 4/2008 | Meals | 602/21 |
| 2008/0097267 | A1 * | 4/2008 | Williams | 602/5 |
| 2008/0163876 | A1 * | 7/2008 | Phelan | 128/879 |
| 2008/0263745 | A1 | 10/2008 | Grilliot et al. | |
| 2008/0271219 | A1 | 11/2008 | Homer | |
| 2008/0281242 | A1 * | 11/2008 | Nyi | 602/21 |
| 2009/0019618 | A1 * | 1/2009 | Winningham | 2/161.1 |
| 2009/0172864 | A1 | 7/2009 | Fisher et al. | |
| 2009/0222967 | A1 | 9/2009 | Winningham et al. | |
| 2009/0240184 | A1 * | 9/2009 | Tadman | 602/22 |
| 2009/0271912 | A1 * | 11/2009 | Jaunault et al. | 2/160 |
| 2009/0281470 | A1 * | 11/2009 | Sandusky et al. | 602/5 |
| 2009/0318041 | A1 * | 12/2009 | Murphy | 441/56 |
| 2010/0004576 | A1 * | 1/2010 | Molnar | 602/22 |
| 2010/0269235 | A1 * | 10/2010 | Parks | 2/2.5 |
| 2011/0046530 | A1 * | 2/2011 | Gaylord et al. | 602/21 |
| 2011/0054371 | A1 * | 3/2011 | Colditz | 602/16 |
| 2011/0066095 | A1 * | 3/2011 | Price et al. | 602/16 |
| 2011/0118635 | A1 * | 5/2011 | Yamamoto | 601/5 |
| 2011/0130694 | A1 * | 6/2011 | Livolsi et al. | 602/21 |
| 2011/0144552 | A1 * | 6/2011 | Farrell et al. | 602/21 |
| 2011/0282253 | A1 * | 11/2011 | Menon et al. | 601/40 |

FOREIGN PATENT DOCUMENTS

| | | | |
|---|---|---|---|
| DE | 2853154 | | 8/1980 |
| DE | 3516545 | | 11/1986 |
| DE | 3516545 | A1 | 11/1986 |
| DE | 8706816 | | 8/1987 |
| DE | 8708682 | | 9/1987 |
| DE | 3725516 | | 9/1988 |
| DE | 3738005 | | 5/1989 |
| DE | 8910050 | | 12/1989 |
| DE | 3516545 | C2 | 2/1994 |
| DE | 9312526 | | 2/1995 |
| DE | 29705586 | | 9/1998 |
| DE | 29808682 | | 10/1999 |
| DE | 29916217 | | 5/2000 |
| DE | 19910799 | | 8/2000 |
| DE | 10010403 | | 9/2001 |
| DE | 10010404 | | 9/2001 |
| DE | 20113431 | | 3/2002 |
| DE | 10100848 | | 8/2002 |
| DE | 20107098 | | 11/2002 |
| DE | 20023139 | | 3/2003 |
| DE | 202004013835 | | 12/2004 |
| DE | 10350448 | | 6/2005 |
| DE | 102005014470 | | 9/2006 |
| DE | 202009006521 | | 7/2009 |
| DE | 102011004039 | | 8/2012 |
| EP | 83454 | | 7/1983 |
| EP | 631735 | | 1/1995 |
| EP | 648437 | | 4/1995 |
| EP | 1527802 | | 5/2005 |
| EP | 1707246 | | 10/2006 |
| EP | 1905319 | | 4/2008 |
| EP | 1905319 | A1 | 4/2008 |
| EP | 2486816 | | 8/2012 |
| HU | 24401/99 | | 6/1999 |
| JP | 09262332 | | 10/1997 |
| JP | 2005131415 | | 5/2005 |
| WO | 9923981 | | 5/1999 |
| WO | 0053275 | | 9/2000 |
| WO | 0100052 | | 1/2001 |
| WO | 2004028282 | | 4/2004 |
| WO | 2005065789 | | 7/2005 |
| WO | 2008008166 | | 1/2008 |

OTHER PUBLICATIONS

Five photographs of a reinforcing element utilized in adidas "Fingersave Glove", on sale at least as early as Feb. 12, 2002, 5 pages.

European Patent Application No. 20040025941, "Extended Search Report", Feb. 11, 2005, 3 pages.

European Patent Application No. 20060005823, "Extended Search Report", May 30, 2006, 6 pages.

European Patent Application No. 20060020573, "Extended Search Report", Apr. 26, 2009, 4 pages.

European Patent Application No. 20120155318, "Extended Search Report", Oct. 18, 2012, 5 pages.

* cited by examiner

WRIST PROTECTOR FOR A SPORT GLOVE

CROSS REFERENCE TO RELATED APPLICATIONS

This application is related to and claims priority benefits from German Patent Application Serial No. 10 2011 004 039.0, filed on Feb. 14, 2011, the entire disclosure of which is hereby incorporated by this reference.

FIELD OF THE INVENTION

The present invention relates to a wrist protector for a sport glove, in particular a goalkeeper glove.

BACKGROUND

Apart from a thermal isolation, gloves typically serve to protect the hands. Injuries may be avoided by resisting or at least cushioning mechanical impacts onto the hand. For example, working gloves are typically made from stable and tear-resistant materials to reduce the risk of cuts to the hand.

A goalkeeper glove fulfills several functions. Apart from improving the grip on the inner side of the hand, it is important to protect the hand against the substantial mechanical loads when deflecting a sharply shot ball. A particular risk for a goalkeeper glove is hyper-extension of individual fingers or the thumb. When a goalkeeper tries to deflect a ball with an extended hand, there is a risk that one or more fingers of the extended hand, which barely contact the ball, will be subjected to the full impact and therefore the finger joints may be hyper-extended. As a result, joints or bones of the finger(s) and/or the hand may be strained or even broken.

Accordingly, in cases where hands and wrists are subjected to particularly high loads, it has been known to include reinforcing elements with goalkeeper gloves and gloves for sports (such as snowboard gloves). The reinforcing elements allow the fingers to bend in a gripping direction, while resisting a bending of the extended fingers in the opposite direction, i.e., in the direction of a hyper-extension. In the case of a goalkeeper glove, the extended hand and in particular individual fingers and the thumb are supported by the glove when deflecting a sharply shot ball.

To obtain the desired mechanical properties, DE 35 16 545 C2 describes manufacturing the backside of a goalkeeper glove in certain areas in two layers. A series of compression-proof bodies forming a second layer are arranged on a flexible but non-yielding first layer (for example a suitable foil). A glove having such a backside can easily bend in a gripping direction, since the first, flexible layer does not provide any significant resistance against such a deformation. However, if the hand and the glove are extended, the compression-proof bodies of the second layer contact each other. Due to the non-yielding nature of the first layer, hyper-extension of the fingers is avoided.

In contrast to the joints of the fingers, the wrist not only enables a bending of the hand towards the palm of the hand, which is designated as flexion in the following (see FIG. 8*b*). The wrist also enables bending, in the opposite direction towards the back of the hand, which is designated as extension in the following (see FIG. 8*a*). Use of a protector against hyper-extension configured for fingers would therefore resist an extension of the wrist and limit the range of motion of hands in an undesirable way. Therefore, the protection against hyper-extension described in DE 35 16 545 C2 is not appropriate for use with the wrist.

In order to avoid hyper-extension of the wrist beyond a maximum normal bending, U.S. Pat. No. 5,778,449 describes a wrist protection with a first rigid brace in the area of the hand and a second rigid brace in the area of the lower arm. The first and second rigid braces are connected by a joint that prevents a bending of the hand beyond a maximum normal bending by a mechanical stop. However, this construction is complex and may limit the mobility of the hand. In addition, a rapid bending of the hand (which may be caused by application of a strong external force), which is suddenly stopped by the mechanical stop may apply a strong impact force to the arm. Application of such an impact force to the arm may not be desired and may even cause pain.

Such a sudden stop can be avoided by use of semi-rigid elements that are arranged on the back of the hand. Examples of such gloves are described in U.S. Pat. No. 6,526,592 B1, U.S. Pat. No. 1,377,103, and U.S. Publication No. 2007/0022512 A1. However, such semi-rigid elements substantially limit the mobility of the hand and do not allow an extension of the wrist up to a maximum angle, since during this bending, a distance along the back of the hand and the lower arm is shortened. This distance shortening can be recognized, for example, from the formation of folds on the back side of a glove or the skin of a hand. Since the semi-rigid elements cannot provide such a shortening, the bending of the hand is limited if the glove carrying these elements is firmly seated at a hand. If not, one end of the semi-rigid elements poke into the lower arm, which is painful.

U.S. Publication No. 2009/0281470 A1 describes a glove with members in the area of the fingers in order to prevent hyper-extension, similar to the protection described in DE 3 516 545 C2. International Publication No. WO 2008/008166 A2 describes a glove with elastically stretchable strips that are arranged on the fingers on the palm side of the hand. The strips are pre-tensioned, causing the finger element associated therewith to curl in a direction of the fingers for gripping an article. German utility model DE 20 2009 006 521 U1 describes a hand protector with finger protection units. Similarly, German utility model DE 200 23 139 U1 relates to a goalkeeper glove with support elements arranged on the back of the fingers. These finger protection units, however, are not affected when the wrist is bent.

Finally, U.S. Pat. No. 6,543,057 B2 describes a protective sporting glove with a thumb protection, which has two sections that are movable with respect to each other and which enable a bending of the thumb. A hyper-extension of the thumb is prevented by a mechanical stop.

The solutions described in the prior art against hyper-extension of the wrist may limit mobility of the wrist and/or may create an undesirable sudden stop of a bending of the wrist. Further, their construction is complex. As a result, it may be desirable to provide a wrist protector for a sport glove, which protects the wrist against hyper-extension and which does not limit mobility. In addition, it may be desirable to provide wrist protector that is easier to manufacture.

SUMMARY

Embodiments of the present invention include a wrist protector for a sport glove comprising a bending element configured to bend during bending of the wrist. The bending element may be further configured so that the length of the bending element changes during bending of the wrist, wherein a change of the length of the bending element leads to an elastic restoring force.

This wrist protector solves a number of problems, which occur when a wrist is to be protected against hyper-extension.

On the one hand, during bending of a hand toward the upper side of the lower arm (i.e. extension as shown in FIG. 8*b*), a distance from the back of the hand to the lower arm is shortened. This becomes apparent by the folds forming on the back side of a glove or the skin of a hand. Conversely, during an opposite bending of the wrist towards the lower side of the lower arm (i.e. flexion as shown in FIG. 8*a*), this distance is prolonged. This problem may be solved by a bending element of the wrist protector which is not only bendable, but also has the ability to simultaneously change its length. The bending element therefore enables a bending of the wrist in both directions and, thus, full range of motion of the hand.

On the other hand, in order to prevent a hyper-extension, the change of length of the bending element leads to an elastic restoring force, which acts against the bending of the hand and thereby prevents a hyper-extension of the wrist. This operation of the bending element resembles a shock absorber. However, in contrast to the shock absorber, the restoring force is not caused by a linear movement but by a bending of the wrist, i.e. a rotational movement.

In some embodiments, the bending element of the wrist protector has a planar shape so that it can be easily integrated into the sport glove. The term "planar shape" is understood to mean that the height of the wrist protector is substantially smaller than its length and width.

In certain embodiments, the bending element comprises a first plate and a second plate configured to shift with respect to each other. This configuration achieves in a simple manner a change of the length of the bending element during bending of the wrist. In some embodiments, the first plate and the second plate may be arranged in an overlapping manner. This overlapping arrangement provides guidance during a movement of the first plate with respect to the second plate.

According to certain embodiments, the bending element further comprises an elastic element. The elastic element generates the elastic restoring force that acts against a hyper-extension of the wrist. The elastic element may also connect the first plate and the second plate. In some embodiments, the elastic element comprises a loop strap, which contributes to a simple assembly of the wrist protector.

By choosing appropriate materials and dimensions, the elastic element may realize various restoring forces which adapt the wrist protector to different situations, for example different expected shot speeds in football. In this way, the wrist protector can be adapted to use by adults or children, to injuries, to different grades of performance, to different sports, or otherwise as desired.

In some embodiments, the first plate and the second plate each essentially have the shape of a "C", i.e. they form of a loop that is open at one end. This shape allows the elastic element (preferably a loop strap) to be pushed over the first plate at the opening of the first plate and then over the second plate at the opening of the second plate in an easy manner so that both plates are connected. The wrist protector with the first plate, the second plate, and the elastic element may therefore be easily manufactured and assembled.

At least the first plate may be reinforced by one or more ridges or crimps. If the wrist bends towards the upper side of the lower arm, the first plate is shifted towards the second plate and thereby extends the elastic element. In some embodiments, it may be desirable to reinforce the first plate by ridges or crimps, in order to avoid a deformation of the first plate in an orthogonal direction to the translation direction of the first plate. This is necessary in order to transfer force to the elastic element and in order to expand it. To this end, the rigidness of the first plate and the second plate has to be adapted to the elasticity of the elastic element, i.e., the rigidness of the first plate has to be higher than the elasticity of the elastic element.

According to certain embodiments, a sport glove may comprise at least one wrist protector as described above. The at least one wrist protector may be arranged on a back side of the sport glove, preferably in a pocket of the sport glove. The back side of the sport glove corresponds to the back of the hand when the glove is worn. This arrangement enables, on the one hand, a force transfer between the wrist protector and the sport glove, wherein the restoring force of the elastic element returns to the sport glove due to the firm arrangement of the wrist protector in the pocket. On the other hand, the wrist protector can be easily exchanged, in order to adapt the sport glove to different situations in which different restoring forces of the wrist protector are needed.

In some embodiments, the first plate may be arranged in an area of a back of the hand and the second plate may be partially arranged in an area of a lower arm when the sport glove is worn. The area of overlap between the first plate and the second plate may be arranged in the area of the back of the hand. Due to this, only the second plate covers the wrist where the hand and the lower arm meet and where a significant curvature occurs during bending. Therefore, the second plate may include sufficiently elastic properties that allow the second plate to substantially conform to the curvature in this area during bending.

In certain embodiments, the sport glove further comprises a protection against hyper-extension for one or more fingers. Preferably, a protector is used which is described in the European patent EP 1 905 319. The term fingers refers to any of the five fingers, which also includes the thumb. The protector against hyper-extension for the fingers can be formed integrally with the wrist protector, or it may be formed as two or more parts.

Further embodiments of the invention are described in further dependent claims.

DETAILED DESCRIPTION

Embodiments of the present invention provide wrist protector for use with a sports glove. While the wrist protector is discussed for use with a goalkeeper glove, it is by no means so limited. Rather, embodiments of the wrist protector may be used with any type of sports glove, such as gloves for other sport disciplines, for example for snowboarding, inline skating, ice hockey, or for working gloves or otherwise as desired. For disciplines like ice hockey, protectors may be applied to the lower arm, the elbow, and the upper arm. At the elbow, a stop may protect against hyper-extension.

Figure 1A:
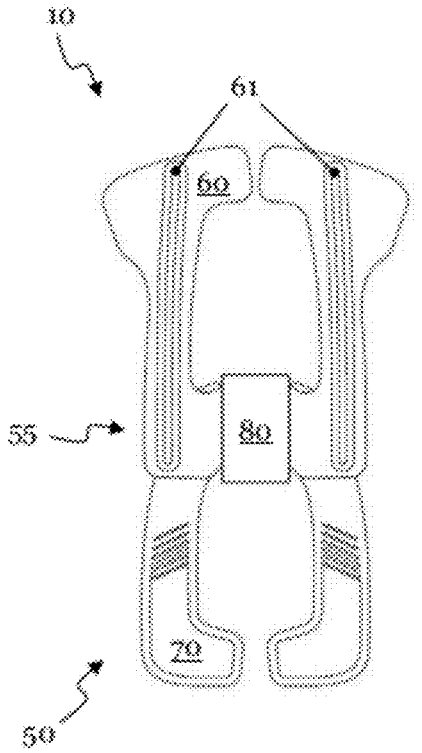
FIG. 1*a* are a top view and a front view of a wrist protector according to certain embodiments of the present invention.
Figure 1A:
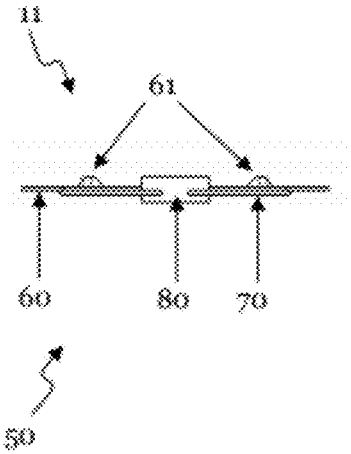

FIG. 1*a* shows certain embodiments of a wrist protector according to the invention. In particular, FIG. 1*a* shows a top view 10 and a front view 11 of the wrist protector, which comprises a bending element 50 with a first plate 60, a second plate 70, and an elastic element 80. The first plate 60 and the second plate 70 may be arranged in an overlapping manner and may be connected to each other by the elastic element 80 in an overlap area 55. In some embodiments, as shown in FIG. 1*a*, the elastic element 80 is formed by a loop strap that encloses the first plate 60 and the second plate 70 in the overlap area 55.

Due to this arrangement, the first plate 60 and the second plate 70 are movably arranged with respect to each other. When the first plate 60 and the second plate 70 move towards each other or away from each other, a restoring force towards the original position is created by the elastic element 80. This will be explained in more detail in the following in connection with FIGS. 3*a-b*.

In some embodiments, as shown in front view 11 of FIG. 1*a*, the bending element 50 may have a planar shape, i.e. it has a small height, wherein the maximum height in the overlap area 55 results from the sum of the heights of the first plate 60, the second plate 70, and the elastic element 80. This maximum height is typically only a few millimeters, for example, 3 mm to 5 mm. Due to this relatively small height, the wrist protector may be integrated into a sport glove without limiting the mobility of the hand during use of the sport glove. In other sports, for example ice hockey, in which mobility is less important than protection, the height of the materials may be larger, which leads to greater rigidity.

In some embodiments, such as where the elastic element 80 may be a loop strap, the elastic element 80 may be mounted easily during manufacture of the wrist protector and moreover may be exchanged easily during use since it is neither fixedly connected to the first plate 60 nor to the second plate 70. Such an exchange may comprise an exchange of the entire bending element 50, the first plate 60, the second plate 70, and/or the elastic element 80. These parts may also be adjusted based the size of a player, wherein the exchange may be carried out from the outside. Elastic element 80 may also be adjusted from the outside, for example by tightening, loosening, or by setting tight. This enables the elastic element 80 to not only cushion, but also block a movement. Further, the first plate 60 and/or the second plate 70 may be exchanged or replaced by other plates with different geometries and/or formed of different materials. The possibility of easily exchanging the elastic element 80 provides an ability to adjust a sport glove with this wrist protector to various situations in which different restoring forces of the wrist protector are required. Such restoring forces may be achieved by using elastic elements with different elasticity, for example, by using straps of different widths and/or thicknesses or by using plural straps.

In other embodiments, the elastic element 80 may be formed as an elastic strap, wherein one end of the strap is connected to the first plate 60 and the other end is connected to the second plate 70. The elastic element 80 is preferably made from rubber or thermoplastic polyurethanes ("TPU"). Further examples of suitable materials may include elastomers, unsaturated rubbers such as polyisoprene, polybutadiene, polyisobutylene, chloroprene, butyl rubber, halogenated butyl rubbers, styrene-butadiene rubbers, and nitrile rubbers, saturated rubbers such as ethylene propylene rubber, epichlorohydrin rubber, polyacrylic rubber, silicone rubber, fluorosilicone rubber, fluoroelastomers, perfluoroelastomers, polyether block amides, chlorosulfonated polyethylene, and ethylenevinyl acetate, thermoplastic elastomers, polysulfide rubber, other materials with elastic properties, and combinations thereof. One of ordinary skill in the relevant art will understand that any suitable design or shape of the elastic element 80 may be used that provides the desired restoring force that returns the first plate 60 and the second plate 70 to their original positions.

The first plate 60 and the second plate 70 may be formed from an elastic plastic, which enables bending of the first plate 60 and the second plate 70. The elasticity of the bending element 50 should have a magnitude such that both a bending of the hand is possible and the elastic element 80 is elongated. However, the bending element 50 should not bend orthogonally to the longitudinal direction of the bending element 50, since this type of bending does not lead to an elongation of elastic element 50. The following explanation in connection with FIG. 1*b* describes how to avoid such an undesired orthogonal bending.

The first plate 60 and the second plate 70 are preferably manufactured from fiber-reinforced TPU, which provides the plates 60, 70 with elastic properties and avoids permanent deformation. Further examples of suitable materials may include but are not limited to flexible plastics such as polyethylene and polypropylene, plastics that may include plasticizers as needed for elasticity such as polyvinyl chloride, polystyrene, poly(methyl methacrylates), and polycarbonate, polymeric fibers such as polyamides and carbon fibers, polyurethane, polystyrene, other plastics, copolymers, composite materials, and blends thereof. The surfaces of the first plate 60 and the second plate 70 may be roughened on the sides facing each other, in order to further increase the breaking effect.

The use of a bendable material provides adjustment of the bending element 50 to the curved form of a wrist during bending of the wrist.

Since the distance covered by the bending element 50 is either shortened or extended during bending of the wrist, the first plate 60 and the second plate 70 are shifted with respect to each other so that elastic element 80 is expanded and thus generates a restoring force. This will be explained in more detail below in connection with FIGS. 3*a-b*.

Figure 1B:
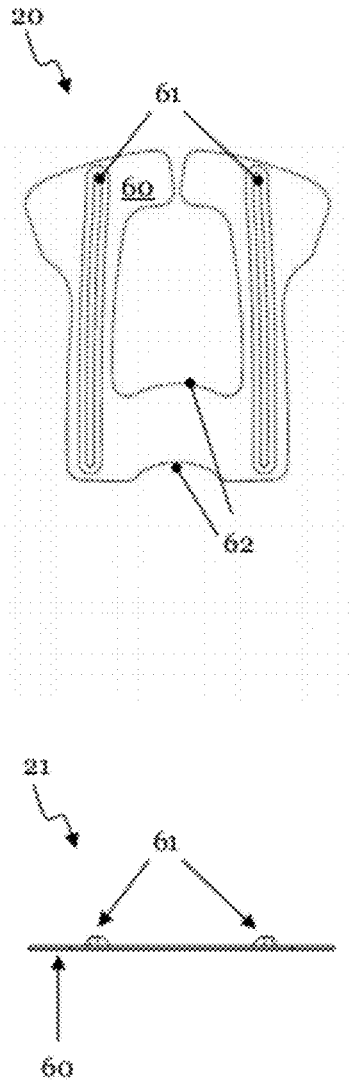
FIG. 1*b* are a top view and a front view of a first plate of the wrist protector of FIG. 1*a*.

FIG. 1*b* further shows a top view 20 and a front view 21 of the first plate 60. These views illustrate two parallel ridges or crimps 61, which may extend along a longitudinal direction of the first plate 60 and which may stiffen the first plate 60 against deformation. The use of the ridges or crimps 61 allows the first plate 60 to be manufactured from a thinner material than otherwise without the ridges or crimps 61. Ridges or crimps 61 may be included with the first plate 60 when the first plate 60 is arranged in the area of the back of the hand of a sport glove, such as in the embodiments illustrated in FIGS. 3-5. In these embodiments, during bending of the wrist towards the upper side of the lower arm, the first plate 60 is shifted with respect to the second plate 70 so that the elastic element 80 is elongated. An enforcement of the first plate 60 by the ridges or crimps 61 has the effect that a larger force can be transferred to the elastic element 80 without deformation of the first plate 60. One of ordinary skill in the relevant art will understand that the ridges or crimps 61 may be included in any location and in any amount as needed in combination with the first plate 60 to achieve the desired amount of support for the first plate 60.

Figure 1C:
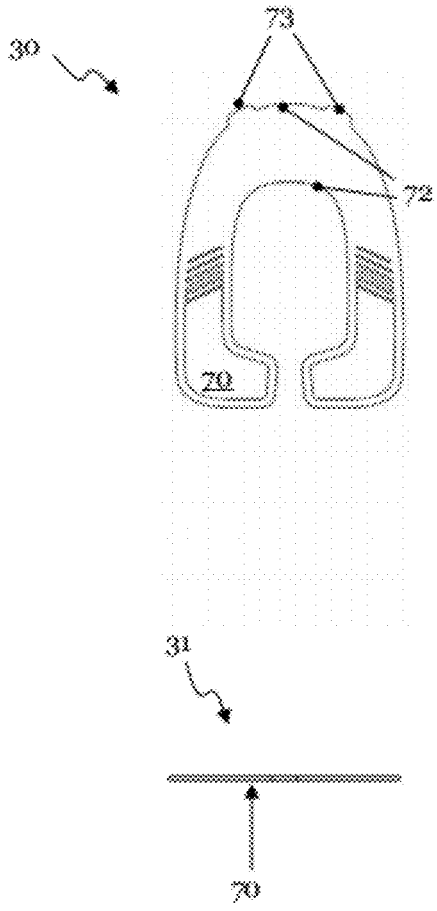
FIG. 1*c* are a top view and a front view of a second plate of the wrist protector of FIG. 1*a*.

FIG. 1*c* further shows a top view 30 and a front view 31 of the second plate 70.

In the embodiments of FIGS. 1*a-c*, the first plate 60 and the second plate 70 have an elongated shape with a hole in the center and an open at one end. This corresponds to the shape of a "C". The opening enables a simple mounting of the bending element 50 by moving the elastic element 80 at first across the opening of one plate and then across the opening of the other plate. The shape of the first plate 60 and the second plate 70 further enables a minimal weight of the bending element 50, which may result in maximum mobility of a sport glove that uses such a wrist protector.

Further, the openings of the two plates 60, 70 enable the plates 60, 70 to adapt their shape to the shape of the hand and the lower arm (transverse curvature) and allows the plates 60, 70 to expand during bending. In some embodiments, the second plate 70 first expands at its open end until the edges of the open end reach the lateral ends of the pocket 58 in which it is located. Once the second plate 70 also reaches the longitudinal ends of the pocket 58, elongation of the elastic element 80 commences.

In some embodiments, the first plate 60 and the second plate 70 may also be designed as a closed plane, having only a slit-like opening for mounting the elastic element 80.

Figure 2A:
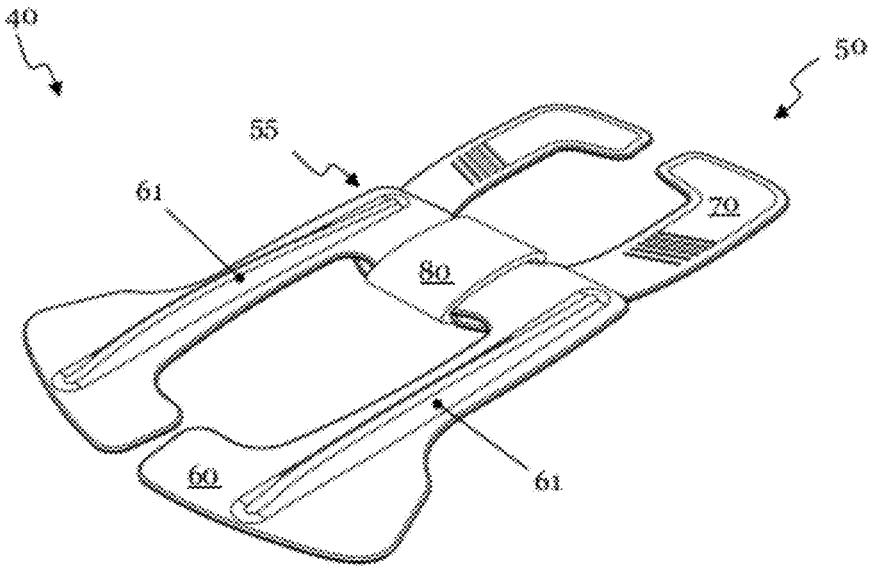
FIG. 2*a* is a perspective view of the wrist protector of FIG. 1.
Figure 2B:
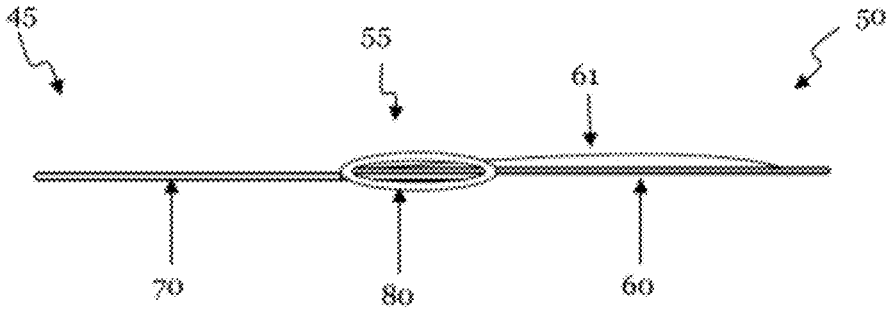
FIG. 2*b* is a cross-sectional view of the wrist protector of FIG. 1.

FIG. 2*a* shows a perspective view 40 and FIG. 2*b* shows a side view 45 of the wrist protector of FIG. 1*a* according to certain embodiments, in which the bending element 50, the first plate 60 with ridges or crimps 61, the second plate 70, the elastic element 80, and the overlap area 55 are illustrated. These views also illustrate that the ridges or crimps 61 may be flattened towards the ends, which avoids sharp edges. Sharp edges may cause injuries and may also result in reduced stability. Further, right angles and sharp edges may have a tendency to be brittle.

Figure 3A:
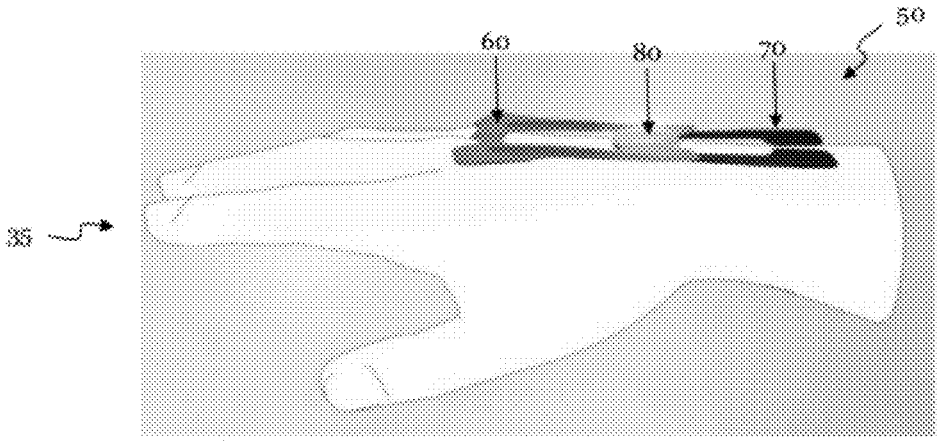
FIG. 3*a* is a schematic perspective view of a straightened position of a hand with the wrist protector of FIG. 1.
Figure 3B:
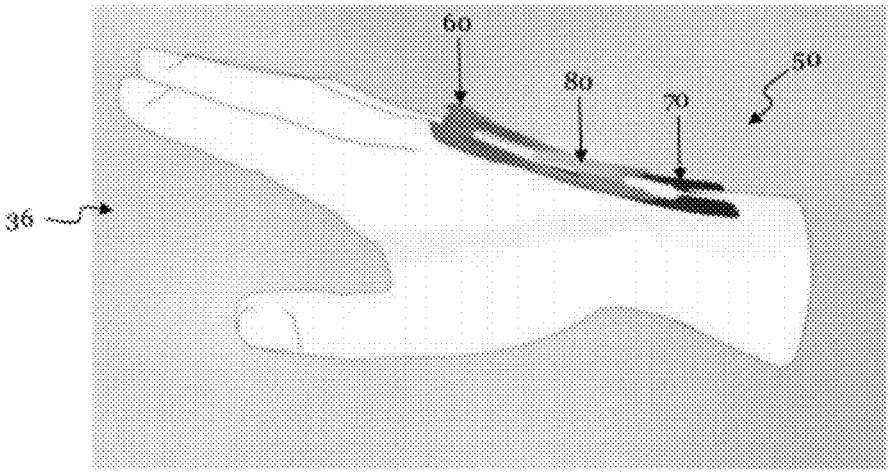
FIG. 3*b* is a schematic perspective view of an extension position of a hand with the wrist protector of FIG. 1.

FIGS. 3*a* and 3*b* illustrate the operating principle of a wrist protector according to some embodiments of the invention, as illustrated in FIGS. 1*a-c* and 2*a-b*, for example. In FIG. 3*a*, the bending element 50 of the wrist protector is coupled to a hand, for example using a glove (not illustrated). The bending element 50 may be arranged in the pocket 58 of the glove, and the glove may be firmly arranged at the hand. This enables a force transfer between the bending element 50 and the hand. In the first state 35, the back of the hand is essentially parallel to the lower arm and the bending element 50 is in its original state, wherein the elastic element 80 is relaxed. In the second state 36, as shown in FIG. 3*b*, an extension of the hand is illustrated, i.e. the back of the hand is bent towards the upper side of the lower arm. Since the center of rotation of this bending is not at the surface of the skin but below the skin, the distance between the back of the hand and the upper side of the lower arm where bending element 50 is arranged becomes smaller. Since the bending element 50 is force-fit coupled to the hand and the lower arm via the glove, the first plate 60 and the second plate 70 are shifted towards each other so that elastic element 80 is elongated and a restoring force is generated. This restoring force acts to return the bending element 50 to the first state 35, as shown in FIG. 3*a*, i.e. against the bending. This arrangement provides protection to the wrist against hyper-extension. The elastic element 80 may also be mounted under pre-tension. For example, a loop strap that forms the elastic element 80 may be shorter in a relaxed state than the overlapping area between the first plate 60 and the second plate 70. This pre-tension may provide a cushioning from the beginning of a bending.

During bending of the wrist towards the second state 36, the first plate 60 is shifted towards the second plate 70 against the restoring force of the elastic element 80. In order to avoid a deformation of the first plate 60 during this shift, the first plate 60 may comprise the ridges or crimps 61, as illustrated in FIGS. 1 and 2.

The wrist protector acts similarly when the hand is bent downwards, i.e. the back of the hand is bent towards the lower side of the lower arm (flexion of the wrist). In this case, the distance between the back of the hand and the upper side of the lower arm is extended where the bending element 50 is arranged. Since the bending element 50 is force-fit coupled to the hand and the lower arm via the glove, the first plate 60 and the second plate 70 are shifted away from each other so that elastic element 80 is elongated and a restoring force is generated. This restoring force acts to return the bending element 50 to the first state 35, i.e. against the bending.

Similar operating principles result if the wrist protector is arranged on the palm of the hand, albeit in reverse of the operation described above. In this case, in contrast to FIGS. 3*a-b*, the bending element 50 is extended during an upward bending (bending of the back of the hand towards the upper side of the lower arm) and contracts during a downward bending (bending of the back of the hand towards the lower side of the lower arm). In both cases, a restoring force to the original position (back of the hand parallel to the lower arm) results. Some embodiments may include wrist protectors both in the area of the back of the hand and at the palm of the hand, for example for snowboarding or inline skating.

Figure 4:
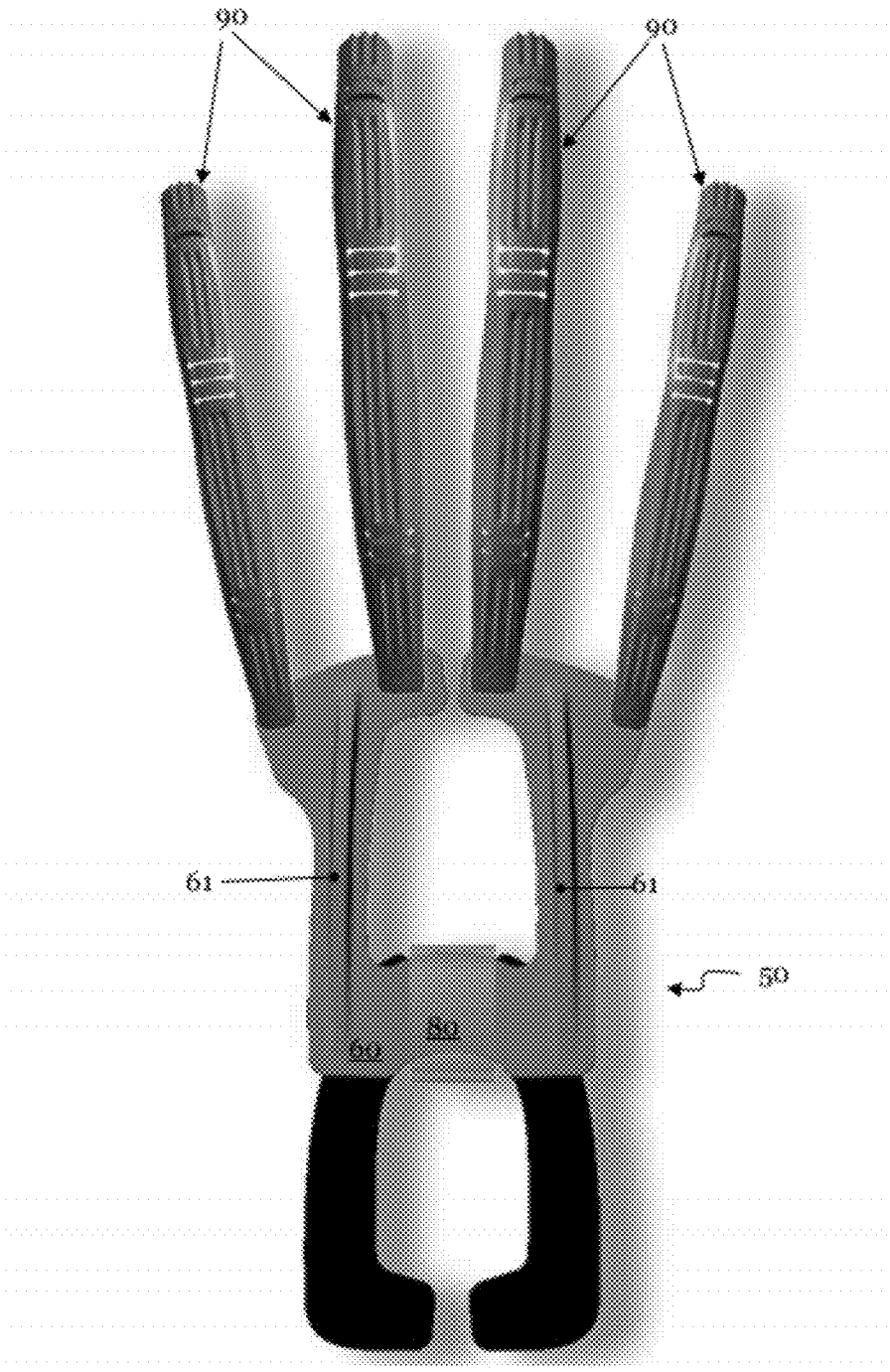
FIG. 4 is a top view of the wrist protector of FIG. 1 in combination with a protector against hyper-extension for fingers.

FIG. 4 illustrates the combination of the bending element 50 with a protective element 90 against hyper-extension for the fingers. In some embodiments, the protective element 90 for fingers is used, which is described in the European patent EP 1 905 319, and incorporated herein by reference in its entirety. Such a combination provides protection against hyper-extension both for the fingers and the wrist.

In certain embodiments, the protective element 90 for fingers is not connected with bending element 50. As a result, both elements 50, 90 may operate independently of each other.

In some embodiments, the protective element 90 slides onto the first plate 60. In these embodiments, it may be desirable that the pressure that is exerted onto the back of the hand by the protective element 90 during extension of the hand is now exerted onto the first plate 60, which then equally distributes this pressure.

Protection of the thumb (not illustrated in FIG. 4) is particularly important for sports like hockey or ice hockey where there is a risk that the hockey stick that is held in the hand presses the thumb backwards and overextends it. Similar risks may be present in other sports or activities that involve a stick, club, bat, or other device that is held in the hand while participating in the sport or activity. The thumb joint operates similarly to the wrist and may be bent backwards up to a particular angle without overextending it. Therefore, a protector designed for a thumb may allow a certain movement to the back, while also cushioning a hyper-extension through a restoring force.

A thumb protector therefore may be provided by a bending element similar to the bending element 50 of the wrist protector described above. The thumb protector would be arranged at a specific angle relative to the bending element 50. The thumb protector and the protective element 90 would not necessarily be arranged in a common plane, due to differences in the locations of a thumb and fingers on a hand. The thumb protector may therefore be arranged in a separate pocket of a sport glove.

In other embodiments, the ends on one side of the protective element 90 are connected to the first plate 60. Preferably, the transition between the protective element 90 for the fingers and the first plate 60 is provided with elastic elements so that a movement in this area is also cushioned, rather than suddenly stopped.

In addition, the single elements of the protective element 90 may be separated into two or three plates, and these plates may be provided with elastic bands at the finger joints.

The elastic elements may also be designed so that they do not generate a restoring force in a particular range of motion. For example, an elastic band may be larger in a relaxed state than the overlapping area between the elements 50, 90, which are connected by the elastic band. A movement of the elements 50, 90 within this area therefore does not generate a restoring force. This range could correspond to a movement of the fingers between a gripping position and the extended fingers. A restoring force would only be generated when the fingers are stretched beyond the extended finger position. Further, the elastic bands may be adjusted as needed to the single joints (for example, stiffened for injuries).

As illustrated in FIG. 4, the elastic element 80 is in a relaxed state when the fingers are stretched. When the fingers are bent, the length of the area covered by the protective element 90 is extended. In embodiments where the ends on a second side of the protective element 90 are firmly arranged at the tips of the fingers, the protective element 90 is pulled away from the bending element 50. Because the first ends on one side of the protective element 90 are connected to the first plate 60 and the bending element 50 is force-fit coupled to the hand and the lower arm via the glove, the first plate 60 is shifted away from the second plate 70 so that the elastic element 80 is elongated and a restoring force is generated. This restoring force acts to return the protective element 90 and the bending element 50 to the original state, i.e. with the fingers stretched.

Figure 5A:
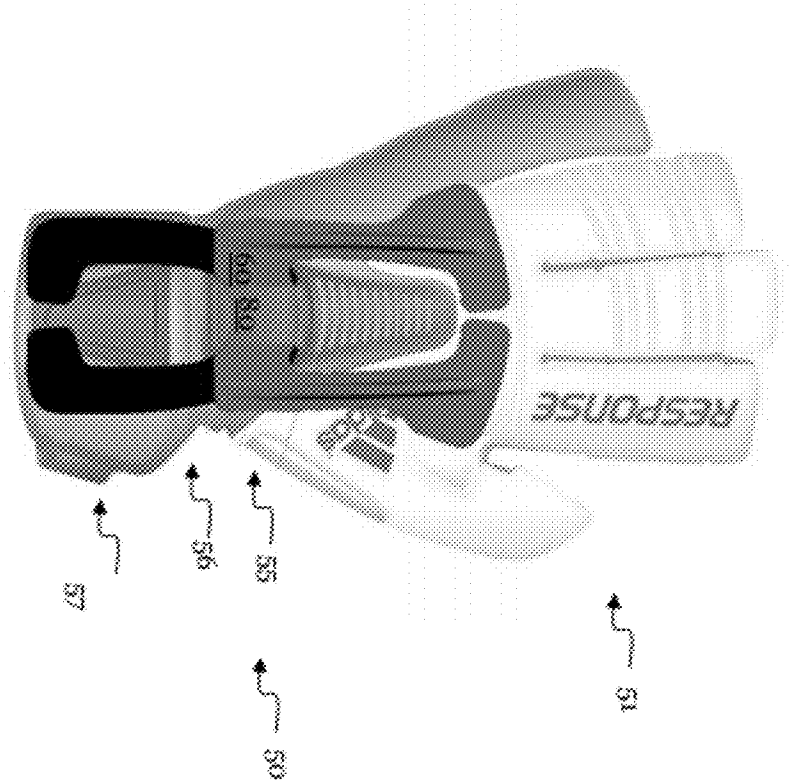
FIG. 5*a* is a schematic top view of a sport glove with the wrist protector of FIG. 1.

FIG. 5*a* illustrates certain embodiments that may include an arrangement of the previously described wrist protector with the bending element 50 in a sport glove 51. As shown, the first plate 60 may be arranged in the area of the back of the hand. The second plate 70 may be arranged both in the area of the back of the hand and in the area of the lower arm. The overlap area 55 between the first plate 60 and the second plate 70 may be arranged in the area of the back of the hand. Area 56 at the wrist, i.e. between the back of the hand and the lower arm, may therefore only be covered by the second plate 70. During bending of the hand, the area 56 may include a significant curvature, such that the second plate 70 may require sufficiently elastic properties that allow the second plate 70 to substantially conform to the curvature of the area 56 in a bent position. In these embodiments where the second plate 70 may include elastic properties, the second plate 70 may also be enforced by ridges.

Figure 5B:
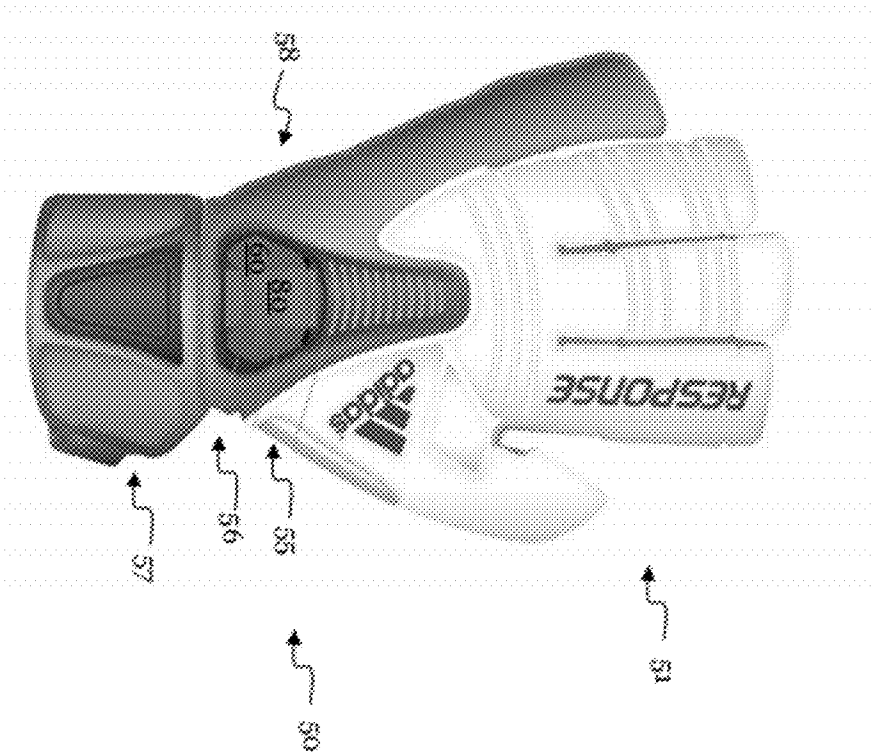
FIG. 5*b* is a schematic top view of a sport glove with the wrist protector of FIG. 1 arranged within a pocket.

To provide a force-fit connection to the sport glove 51, in some embodiments, the wrist protector may be arranged in a pocket 58, the size of which corresponds to the wrist protector, as illustrated in FIG. 5*b*. The pocket 58 may enclose at least the upper part of the first plate 60 adjacent the opening in the first plate 60 (undercut) so that it cannot slip out of the pocket 58. The first plate 60 is configured to broaden in width toward the opening, which allows the first plate 60 to cover all knuckles and/or to form the undercut that is enclosed by the pocket 58. This broadening may be seen in FIG. 1*c*. The first plate 60 is therefore protected against slipping in a longitudinal direction.

In contrast, the second plate 70 is slideable within the pocket 58 in a longitudinal direction. Therefore, a flexion in the gripping direction is not restricted by attachment of the bending element 50 to the sport glove 51.

A sliding layer may be arranged between the material of the back of the glove (textile material) and the elastic element 80 (which may be manufactured from rubber or TPU) because the materials used to form the elastic element 80 may not slide well on a rough material such as a textile material. The sliding layer may comprise, for example, a thin layer of smooth material, such as plastic or other suitable types of materials. This layer may be glued or sewn or otherwise attached to the back of the glove.

The pocket 58 may be accessible and lockable in order to enable an easy exchange of the wrist protector. Alternatively, the wrist protector may be fixed within or on the glove using appropriate means, for example by sewing, reverting, gluing or by a reversible connection, using hook and loop type connectors, press buttons, or other suitable fasteners. In the examples where the wrist protector is sewn onto the glove, the plates 60, 70 of the bending element 50 may comprise holes through which sewing may be performed. Windows in the pocket 58 make the wrist protector visible from outside. Different colors may indicate different properties (strength of the restoring force, elasticity of the plates, etc.)

The arrangement of the wrist protector on the back of the hand is often preferable, as this location may have less influence on the gripping mechanism with the palm of the hand. However, in cases where gripping is of less concern or where other factors indicate that other locations for the wrist protector should be considered, an arrangement of the wrist protector on the palm of the hand may be preferable.

In some embodiments, it may be desirable that the sport glove 51 of FIG. 5*b* is fixed to the lower arm in a lower arm area 57 by appropriate fasteners, such as a rubber strap with hook and loop type connectors. This type of connection supports the function of the wrist protector so that during bending of the hand, the first plate 60 and the second plate 70 are shifted with respect to each other that results in an expansion of the elastic element 80. Namely, if the sport glove 51 is not firmly connected to the hand and in particular to the lower arm, the shifting of the first plate 60 may cause a shifting of the sport glove 51 with respect to the lower arm, instead of expanding the elastic element 80.

In further embodiments, the sport glove 51 may comprise several wrist protectors. This provides a particularly high restoring force and a corresponding effective protection of the wrist from hyper-extension. One of ordinary skill in the relevant art will understand that any suitable number and location of wrist protectors and/or finger protectors may be used separately or in combination to achieve the desired protection for the wrist and/or the fingers.

The design of the bending element 50 also enables a bending of the hand with respect to an axis orthogonal to the palm of the hand, which is designated as a deviation. The corresponding movements of a right hand are illustrated in FIGS. 8*c-d*. A radial deviation of the right hand is illustrated in FIG. 8*c*, and an ulnar deviation of the right hand is illustrated in FIG. 8*d*. Such bending is enabled by a curvature 62 of the first plate 60 and a curvature 72 of the second plate 70 in the overlapping area (see FIGS. 1*b-c*). The bending is limited at the boundary of curvature 62 (where the curvature reverses) of the first plate 60 and by noses 73 of the second plate 70.

Figure 6:
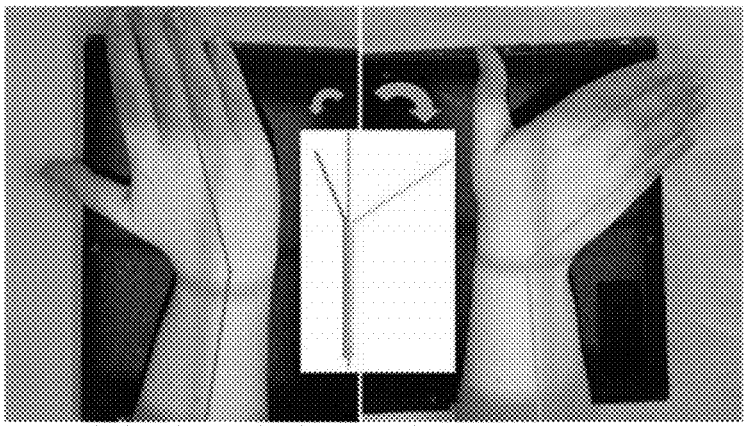
FIG. 6 is an illustration of the asymmetry between a radial and an ulnar deviation of the wrist.
Figure 7:
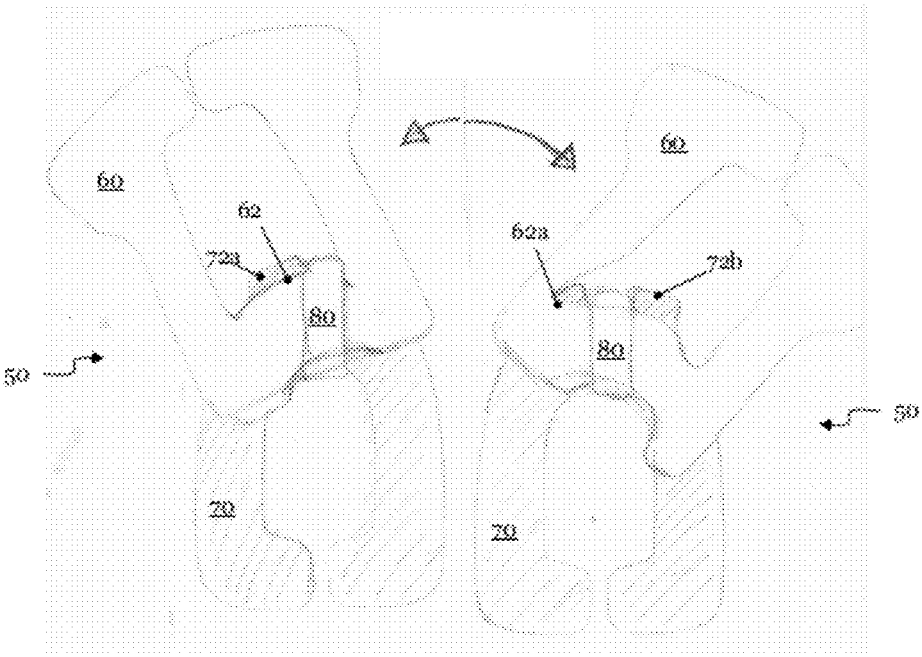
FIG. 7 is a top view of a wrist protector according to other embodiments of the present invention.

FIG. 6 illustrates that there is an asymmetry between the radial deviation and the ulnar deviation of the wrist. This asymmetry means that the ulnar deviation may be substantially larger than the radial deviation. Such asymmetric deviations are supported by alternative embodiments of the bending element 50, as illustrated in FIG. 7. In the left part of FIG. 7, a bending of the bending element 50, which corresponds to a radial deviation, is limited by the boundary of curvature 62 of the first plate 60 and nose 72*a* of the second plate 70. A larger ulnar deviation in the right part of FIG. 7 is enabled by an additional recess 62*a* of the curvature 62 of the first plate 60, together with nose 72*b* of the second plate 70.

Figure 8A:
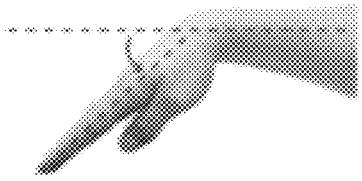
FIG. 8*a* is a side view of a flexion position of a hand.
Figure 8B:
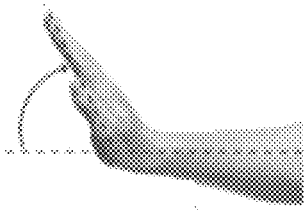
FIG. 8*b* is a side view of an extension position of a hand.
Figure 8C:
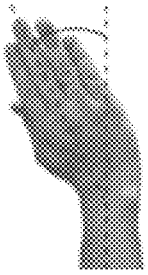
FIG. 8*c* is a top view of a radial deviation of a hand.
Figure 8D:
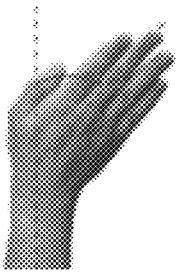
FIG. 8*d* is a top view of an ulnar deviation of a hand.

FIGS. 8*a-d* illustrates terms for movements of a hand. FIG. 8*a* illustrates flexion, wherein the palm of the hand is bent towards to lower side of the lower arm. Flexion can reach 80 to 90 degrees. FIG. 8*b* illustrates extension, wherein the hand is bent in the opposite direction. An extension can reach approximately 70 degrees. FIG. 8*c* illustrates a radial deviation of the right hand, wherein the thumb approaches the radius and the hand is bent by approximately 20 degrees. FIG. 8*d* finally illustrates an ulnar deviation, wherein the small finger approaches the ulna and the hand is bent by approximately 30 to 50 degrees.

The foregoing is provided for purposes of illustrating, explaining, and describing embodiments of the present invention. Further modifications and adaptations to these embodiments will be apparent to those skilled in the art. The features and aspects of the present invention have been described or depicted by way of example only and are therefore not intended to be interpreted as required or essential elements of the invention unless otherwise so stated. It should be understood, therefore, that the foregoing relates only to certain exemplary embodiments of the invention, and that numerous changes and additions may be made thereto without departing from the spirit and scope of the invention as defined by any appended claims.

That which is claimed is:

1. A wrist protector for a sport glove comprising:

(a) a bending element configured to bend during bending of a wrist;

(b) wherein the bending element is further configured so that its length changes during bending of the wrist;

(c) wherein a change of the length of the bending element leads to an elastic restoring force; and (d) wherein the bending element comprises a first plate having a curved portion with bounded ends, a separate second plate having a curved portion with bounded ends, wherein the curved portion of the first plate and the curved portion of the second plate at least partially overlap, and an elastic element at least partially overlapping the curved portions of the first plate and the second plate between the bounded ends to couple the first plate to the second plate, wherein the elastic element allows the first plate and the second plate to longitudinally shift with respect to each other during longitudinal bending of the wrist, and to radially shift with respect to each other between the bounded ends of the curved portions to provide limited orthogonal bending of the wrist.

2. The wrist protector of claim 1, wherein the bending element has a planar shape.

3. The wrist protector of claim 1, wherein the elastic element comprises a loop strap.

4. The wrist protector of claim 1, wherein the first plate and the second plate respectively have the form of a loop that is open at one end.

5. The wrist protector of claim 1, wherein the first plate is reenforced by ridges or crimps.

6. A sport glove comprising a wrist protector, wherein the wrist protector comprises:

(a) a bending element configured to bend during bending of a wrist;

(b) wherein the bending element is further configured so that its length changes during bending of the wrist;

(c) wherein a change of the length of the bending element leads to an elastic restoring force; and (d) wherein the bending element comprises a first plate having a curved portion with bounded ends, a separate second plate having a curved portion with bounded ends, wherein the curved portion of the first plate and the curved portion of the second plate at least partially overlap, and an elastic element at least partially overlapping the curved portions of the first plate and the second plate between the bounded ends to couple the first plate to the second plate, wherein the elastic element allows the first plate and the second plate to longitudinally shift with respect to each other during longitudinal bending of the wrist, and to radially shift with respect to each other between the bounded ends of the curved portions to provide limited orthogonal bending of the wrist.

7. The sport glove of claim 6, wherein the wrist protector is arranged on a backside of the sport glove, wherein the back side of the sport glove covers a back of a hand when the sport glove is worn.

8. The sport glove of claim 6, wherein the wrist protector is arranged in a pocket of the sport glove.

9. The sport glove of claim 6, wherein the wrist protector is exchangeable.

10. The sport glove of claim 6, wherein the sport glove further comprises a protective element for one or more fingers.

11. A sport glove comprising a wrist protector for a sport glove, wherein the wrist protector comprises:

(a) a bending element configured to bend during bending of a wrist;

(b) wherein the bending element is further configured so that its length changes during bending of the wrist;

(c) wherein a change of the length of the bending element leads to an elastic restoring force; and (d) wherein the bending element comprises a first plate having a curved portion with bounded ends, a separate second plate having a curved portion with bounded ends, wherein the curved portion of the first plate and the curved portion of the second plate at least partially overlap, and an elastic element at least partially overlapping the curved portions of the first plate and the second plate between the bounded ends to couple the first plate to the second plate, wherein the elastic element allows the first plate and the second plate to longitudinally shift with respect to each other during longitudinal bending of the wrist, and to radially shift with respect to each other between the bounded ends of the curved portions to provide limited orthogonal bending of the wrist.

12. A sport glove comprising at least one wrist protector of claim 11, wherein the first plate is arranged in an area of a back of a hand when the sport glove is worn.

13. A sport glove comprising at least one wrist protector of claim 11, wherein the second plate is partially arranged in an area of a lower arm when the sport glove is worn.

14. A sport glove comprising at least one wrist protector of claim 11, wherein the overlapping curved portions of the first plate and the second plate are arranged in an area of a back of a hand when the sport glove is worn.

* * * * *